US008360668B1

(12) United States Patent
Hinnant

(10) Patent No.: US 8,360,668 B1
(45) Date of Patent: Jan. 29, 2013

(54) SCRUB BRUSH

(76) Inventor: Wayne M. Hinnant, Philadelphia, PA (US)

( * ) Notice: Subject to any disclaimer, the term of this patent is extended or adjusted under 35 U.S.C. 154(b) by 470 days.

(21) Appl. No.: 12/575,159

(22) Filed: Oct. 7, 2009

Related U.S. Application Data

(60) Provisional application No. 61/103,282, filed on Oct. 7, 2008.

(51) Int. Cl.
*A46B 11/02* (2006.01)

(52) U.S. Cl. ..... 401/188 R; 401/6

(58) Field of Classification Search ..... 401/6, 188 R, 401/270, 263, 205, 207
See application file for complete search history.

(56) References Cited

U.S. PATENT DOCUMENTS

| | | | | |
|---|---|---|---|---|
| 1,011,115 | A | | 12/1911 | Button |
| 1,173,194 | A | | 2/1916 | Kohl et al. |
| 2,116,864 | A | | 5/1938 | Fehrenbach |
| D114,198 | S | | 4/1939 | Muller-Munk |
| 2,630,594 | A | | 3/1953 | Fisher |
| 2,736,913 | A | | 3/1956 | Mirth |
| D179,985 | S | | 4/1957 | Scholl |
| D180,848 | S | | 8/1957 | Scholl |
| D183,065 | S | | 6/1958 | Schotland |
| 3,067,450 | A | | 12/1962 | Mirth |
| D227,623 | S | | 7/1973 | Spydevold |
| 3,903,888 | A | | 9/1975 | Buelow et al. |
| 3,910,265 | A | | 10/1975 | Coleman |
| 4,078,865 | A | | 3/1978 | Moser |
| D250,229 | S | | 11/1978 | Werner |
| 4,229,116 | A | | 10/1980 | Moore |
| 4,236,651 | A | | 12/1980 | Meyer et al. |
| 4,508,108 | A | | 4/1985 | Miyaoka |
| D294,202 | S | | 2/1988 | Adair |
| 4,998,836 | A | | 3/1991 | Scripnick |
| D323,568 | S | | 1/1992 | Hackler |
| D334,665 | S | | 4/1993 | Johnson |
| D343,924 | S | | 2/1994 | Kaplan |
| D346,698 | S | | 5/1994 | Hinnant |
| D376,912 | S | | 12/1996 | Stein |
| 5,673,455 | A | | 10/1997 | Per-Lee et al. |
| 5,851,077 | A | * | 12/1998 | Trejo ..... 401/6 |
| 5,931,591 | A | | 8/1999 | McCracken |
| 5,961,235 | A | * | 10/1999 | Kennedy ..... 401/6 |
| 6,129,469 | A | * | 10/2000 | Messer et al. ..... 401/6 |
| 6,244,776 | B1 | * | 6/2001 | Wiley ..... 401/208 |
| 6,412,997 | B2 | * | 7/2002 | Berke et al. ..... 401/6 |
| 6,439,790 | B1 | | 8/2002 | Kay |
| D484,314 | S | | 12/2003 | DiGioia |
| D490,614 | S | | 6/2004 | Katz et al. |
| D523,642 | S | | 6/2006 | Hollinger |
| D524,545 | S | | 7/2006 | Hinnant |
| 7,503,715 | B2 | * | 3/2009 | Khubani ..... 401/6 |

(Continued)

OTHER PUBLICATIONS

Advertisement by Dynamic Living, Inc. "Soap Dispensing Back Brush" Copyright 1997-2007 (2 pages).

*Primary Examiner* — David Walczak
(74) *Attorney, Agent, or Firm* — Volpe and Koenig, P.C.

(57) ABSTRACT

A scrub brush includes a channel at least partially through the body, a first end and a second end, including a brush head receiving portion adjacent the first end. A brush head is positioned adjacent the first end, the brush body including a handle portion adjacent the second end. The handle portion may include an actuator, a reservoir adapted to receive a liquid cleaner, a pump, the pump actuated by the actuator. Actuation of the actuator delivers liquid cleaner from the reservoir to the brush head for scrubbing/cleaning. At least a portion of the handle portion preferably contains a transparent window adapted to show the contents of the reservoir. A hanging flange is provided having an opening formed along the spine of the body of the brush adjacent the brush head portion.

12 Claims, 15 Drawing Sheets

U.S. PATENT DOCUMENTS

D599,114 S 9/2009 Hinnant
2005/0260028 A1* 11/2005 Gu ..... 401/188 R
2006/0008313 A1* 1/2006 Wisniewski ..... 401/6
2006/0168749 A1 8/2006 Chang

* cited by examiner

SCRUB BRUSH

CROSS REFERENCE TO RELATED APPLICATION(S)

This application claims the benefit of U.S. Provisional Patent Application No. 61/103,282 filed on Oct. 7, 2008, the entire contents of all of which are incorporated by reference as if fully set forth herein.

FIELD OF INVENTION

This invention relates to the field of scrub brushes.

BACKGROUND

Presently, scrub, bath, cleaning and/or shower brushes (referred to sometimes as "scrub brushes," "bath brushes," "shower brushes," "brushes", or "soap dispensing brushes") are known which allow a user to scrub various parts of their body, toilets, surfaces, appliances, pets, or other uses.

Known brushes suffer from various problems. Such brushes are difficult to hang in the bath or shower in a manner that is helpful, comfortable or convenient to a user. Such brushes include caps which do not provide the best manner of maintaining liquid (which may including liquid cleaner, cleanser and/or soap) within the brush prior to dispensing, causing such known bath brushes to leak. Such brushes do not include a grip that is helpful or easy to use by senior users who may have arthritic hands, fingers or other joints. Such known brushes do not have an ergonomic design. Such known brushes have handles of a single length, that cannot be adjusted to reach extremities or accommodate users of different body types and sizes. Known brushes may not include a means for a user to determine how much liquid soap is in the brush without a user opening the brush and looking inside. Known brushes use hand pumps to dispense soap, which may be difficult for a senior user for the aforementioned reasons. Known brushes may have a pre-formed neck angle that cannot be adjusted.

Accordingly, there is a need to address the problems identified with known brushes. The present invention satisfies these needs and others.

SUMMARY

The present invention is a liquid dispensing brush having an ergonomic shape, and comprising an improved cap having internal threads to prevent leakage (an internal washer may also be provided); a grip or tab on the cap for easy operation (such as by arthritic fingers); an extension and opening for hanging the brush from, for example, a shower head, where the opening is located at the back of the brush head; a telescoping portion of the handle; a spring-biased lever for controlling the telescoping operation or folding (if the brush has a folding body); a window to show the fluid level; a motorized version for dispensing fluid (with various operational buttons); a vibrating brush head; and, a pivoting, spring-biased neck. A soap dispensing brush according to the present invention may include any combination of the foregoing features.

DETAILED DESCRIPTION OF THE PREFERRED EMBODIMENT(S)

Figure 1:
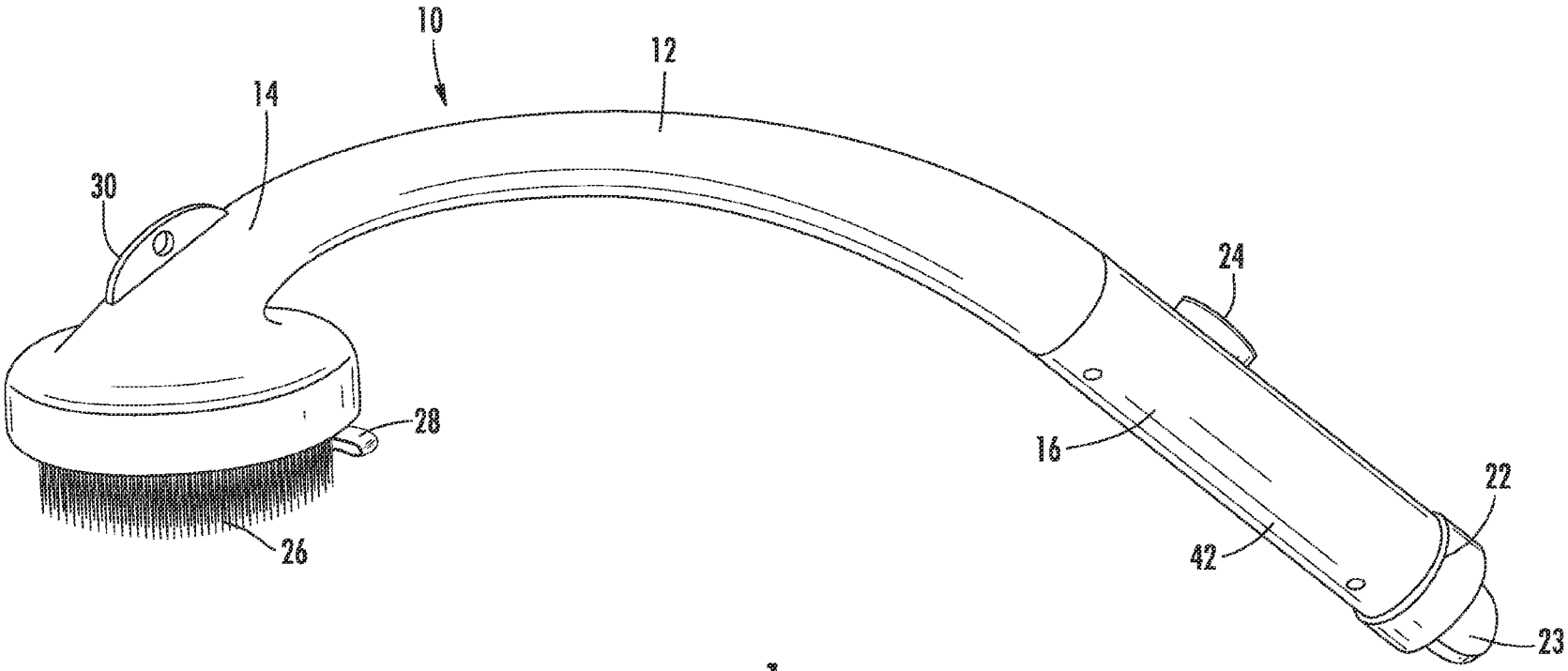
FIG. 1 is an isometric view of a brush according to the present invention.

FIG. 1 shows an embodiment of a soap dispensing brush 10 according to the present invention. The brush 10 includes a brush body 12 having a handle portion 16, a curved neck portion 14, and a brush head receiving portion 18. The brush body 12 preferably includes a passage 20 at least through portions thereof, as described in greater detail below.

Figures 7A, 7B:
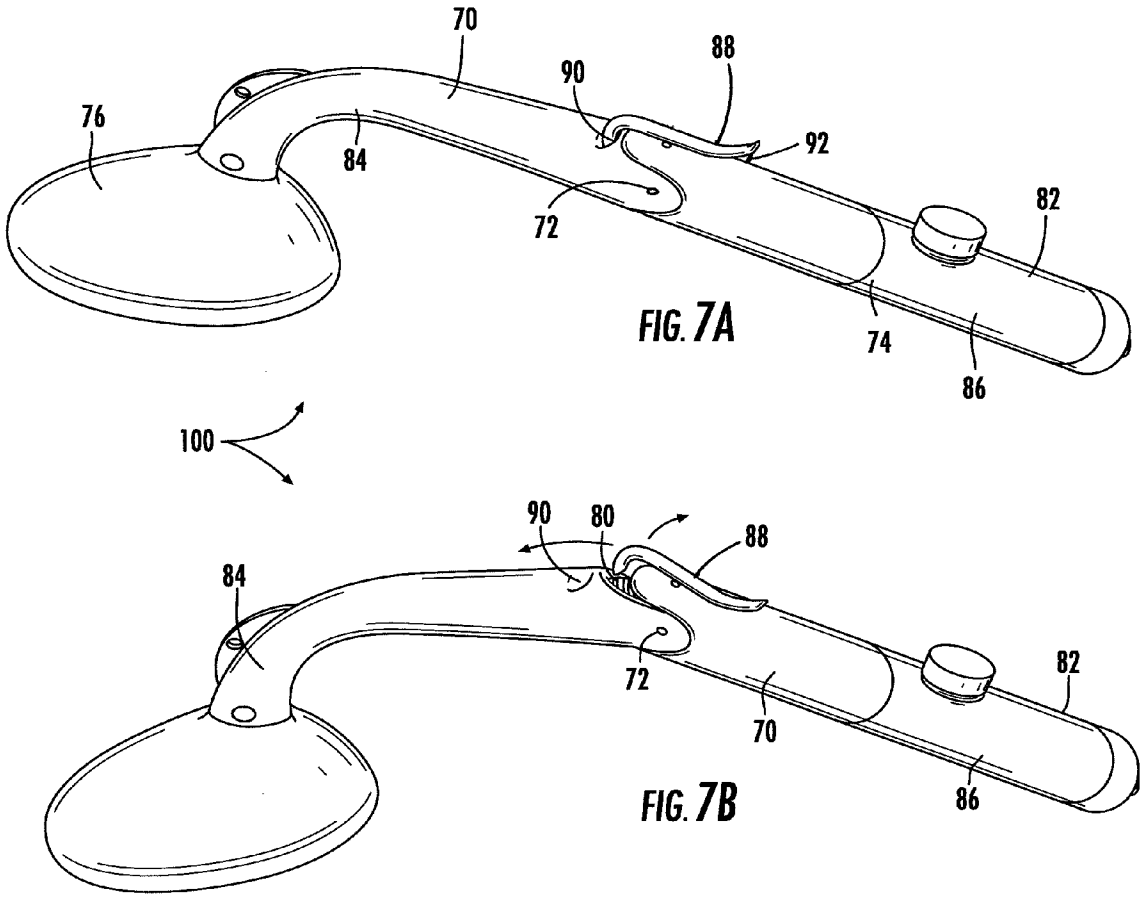
FIGS. 7A and 7B show embodiments of a brush of the present invention where the handle is a foldable handle.

The neck portion 14 may have a portion that is spring biased and may move or pivot when the brush head receiving portion 18 is moved. The brush neck portion 14 may include a hinge 72 between the brush head receiving portion 18 and the handle portion 16, as shown in FIGS. 7A and 7B and described in greater detail below.

The handle portion 16 is generally the area where a user will grip the soap dispensing brush 10 during use, although it is appreciated that a user could grip the brush 10 at any point, and may use one or two hands for gripping the brush 10. The handle portion 16 further preferably includes a removable end-cap 22 adjacent the handle portion 16. The handle portion 16 preferably includes an actuation button 24 for selectively dispensing liquid, such as a liquid soap, from the brush 10. It is appreciated that the liquid may be water, a cleaning solution, a liquid soap, a liquid cleanser, or any other liquid a user would like to have dispensed from the brush 10.

The handle portion 16 has a shape and dimension which is sized for ease of gripping by arthritic hands. A larger diameter has been found to be easier to grip for senior, injured or otherwise debilitated users. The handle portion preferably has a diameter of approximately between about 1 inch to 2 inches at its widest point. In addition, such a curved shape as shown in the Figures provides for ease of use in reaching, for example, the back or legs during a shower. This shape is considered ergonomic, in that the shape and arrangement of the brush of the present invention is designed to minimize effort and discomfort during scrubbing "hard to reach" places. As shown in the Figures, the brush head receiving portion 18 may be preferably curved, angled or tilted toward the brush body 12. In this manner, a user can scrub, for example, their back, legs or underside without excessive manipulation of the brush, and without too much bending or uncomfortable bodily contortions. A straight brush body cannot provide this comfort.

The brush head receiving portion 18 includes a brush head 26, which is preferably removable, such as by snapping engagement with the brush head receiving portion 18. The brush head 26 may be provided as a cartridge that snaps into place to secure the brush head 26 to the brush head receiving portion 18. The brush head 26 preferably includes bristles 27, which may be formed of any material or configuration adapted for scrubbing, cleaning or washing. The brush head 26 includes an opening 19 in communication with tube 40, allowing liquid to be dispensed when the pump 53 is actuated. A funnel 58 may be provided as a transitional portion connecting the tube 40 and the opening 19 in the brush head 26.

Figure 16:
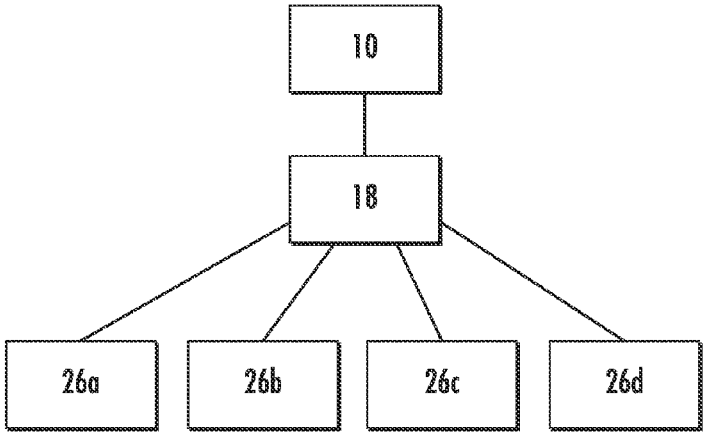
FIG. 16 shows a schematic view of a brush kit having multiple brush heads of varying configurations.

A strap or tab 28 is provided attached to the brush head 26 to provide the user with a means to easily remove the brush head 26. It is contemplated that various types of brush heads may be included in a kit when the brush of the present invention is sold to a user, as shown schematically in FIG. 16, with each brush head (26*a*-26*d*) formed having a different configuration. In that manner, a user can have a choice of, for example, brushes having bristles of different materials (synthetic or natural bristles for example, rubber, etc.), firmness, different textures, or different brush and/or bristle designs, providing the user with various options for cleaning their body. The brush head receiving portion 18 could be equipped with a vibrating element 67 for scrubbing or body massage, as is known in the art. The vibrating element 67 is shown schematically in FIG. 2.

A hanging flange or tab 30 including an opening 32 for receiving, for example a rope, string, or similar article, is preferably positioned at a location along the back or spine of the brush body most preferably positioned adjacent to the position where the neck portion 14 transitions to the brush head receiving portion 18. The hanging flange 30 is positioned on the opposite side of the brush 10 from the direction the brush head 26 faces, as shown in FIG. 1. The hanging flange 30 is positioned so that when a rope (or any material for hanging the brush 10 such as a string, strip, strap, piece of elastic, a band, or any other similar item) is placed through opening 32, the brush 10 may be suspended from a hook or other hanger in a user's bathroom or shower, with the brush head side up, and the handle side down. This provides for a better hanging arrangement then prior brushes. In this manner, liquid will not leak from the brush head portion when stored between uses. Known brushes also had leaking problems in connection with caps which where inserted into the body of known brushes. An improved end-cap 22 is provided herein, which is described in greater detail below, and which allows the present brush to be hung with the brush head side up, and the handle side down, while avoiding leakage.

Figure 2:
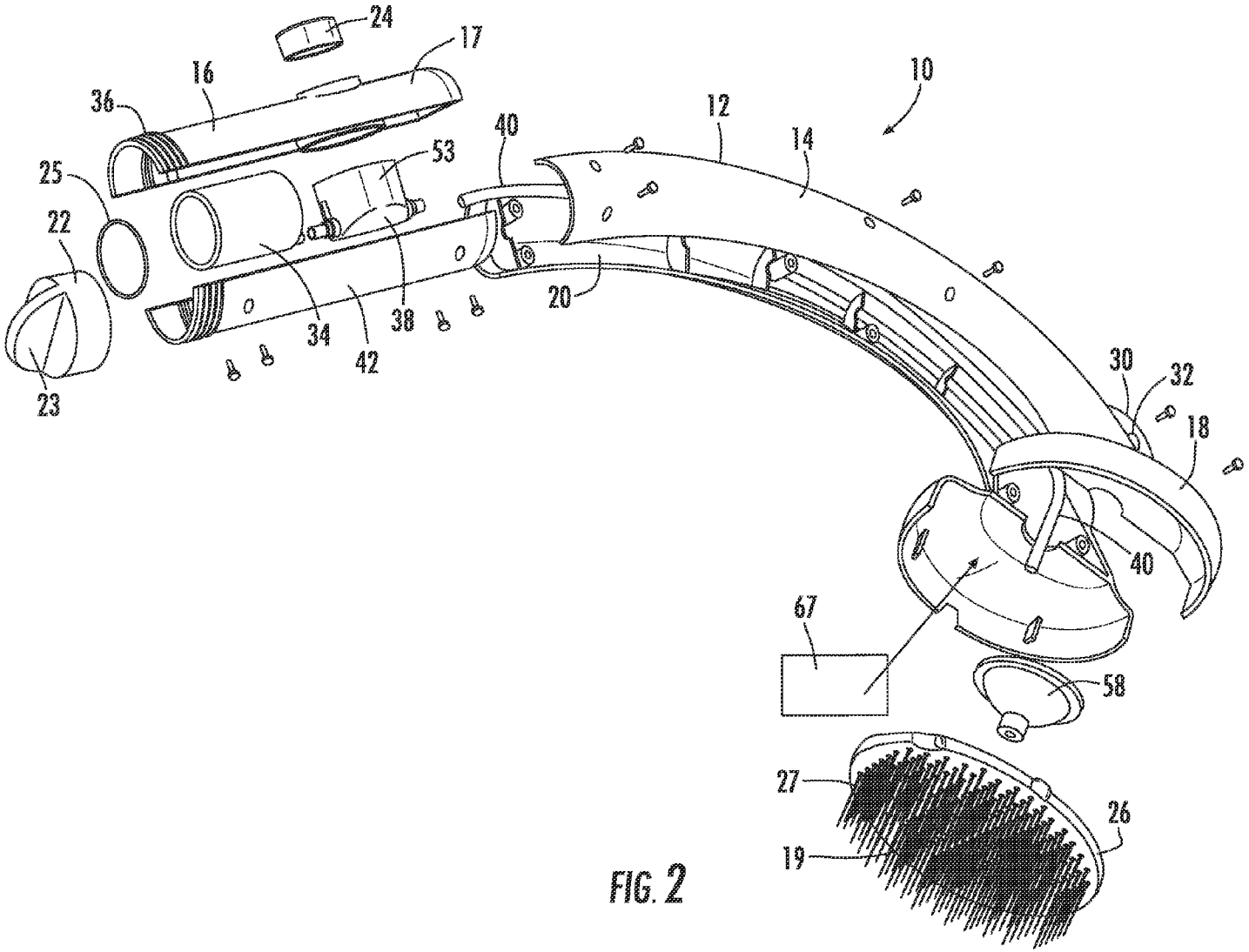
FIG. 2 is an exploded view of a brush according to the present invention.
Figure 3:
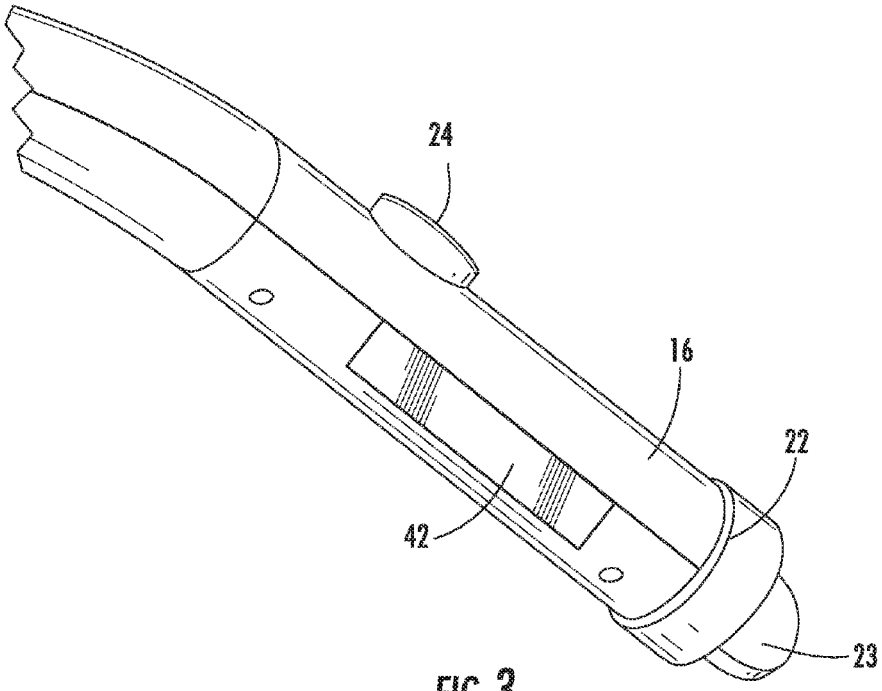
FIG. 3 is an isometric view of a handle portion of an embodiment of a brush according to the present invention.

FIG. 2 shows an exploded view of an embodiment of the present invention. Passage 20 extends through the body 12 of the brush 10 to, for example, accommodate various internal parts contained within the body 12. The end-cap 22 is preferably sized to be larger than the diameter of the opening of the handle portion 16, fitting snugly around the end of the handle portion 16. The end-cap 22 is internally threaded. The end of the handle portion 16 to which the end-cap removably engages is threaded with external threads 36. This arrangement is a marked improvement in leak prevention over known brushes, as known brushes have caps that insert inside the handles of the brush. A washer 25 may be disposed between the end-cap 22 and the handle portion 16 to further prevent leaks. The end-cap 22 preferable includes a tab 23 for gripping to unscrew the end-cap 22. The tab 23 is preferably sized to be about as wide as the diameter of the handle portion 16, for each of use by arthritic hands or fingers.

A reservoir portion 34 is preferably provided at least partially within the handle portion 16, configured to receive and hold liquid such as liquid soap until required by a user. An actuation portion 38 is preferably provided configured to receive liquid such as liquid soap and is in fluid communication with the reservoir portion 34. The actuation portion may act as a flow control portion in controlling the flow of liquid through the brush. As shown in FIG. 2, a button 24 may pass through an opening in the wall 17 of the handle portion 16, and is in operative communication with the actuation portion 38. The actuation portion 38 preferably includes a button-actuated pump 53 configured to pump liquid when selectively actuated by a user pressing the button 24. Preferably, the button 24 is spring or otherwise biased to the un-actuated or de-actuated position after each actuation, thus a user can pump the button to dispense additional liquid. Actuation portion 38 is in fluid communication with the reservoir 34.

Preferably, a liquid dispensing tube 40 is provided with a first end in fluid communication with the actuation portion 38 and a second end in fluid communication with the brush head 26. The tube 40 runs along the length of the passage 20, as shown in FIG. 2. The tube 40 is preferably a flexible tube adapted to convey liquid soap from the reservoir to the brush head 26 via the actuation portion 38 and/or pump.

The brush head 26 is formed to snap into the brush head receiving portion 18. Various replacement brush head configurations may be provided for use with the brush of the present invention. For example, brushes and/or bristles of different stiffness, materials, or attributes, may be provided. Examples include, but are not limited to: a brush head having a rubberized portion such as with rubber "fingers" or rubber extensions (26*a*); a rubberized brush head with rounded protrusions for a massage-type of action (26*b*); naturals bristles such as of boar's hair (26*c*); bristles formed from a plastic or polymer (26*d*); or combinations of any of the foregoing. Such different configuration could be provided in a kit, and each configuration could include a hand strap 99 for use as a separable scrubbing instrument adapted for use by hand separate and apart from the brush body.

The brush head 26 includes an opening 19 for dispensing fluid, as shown in FIG. 2. Thus, fluid pumped through the brush body 12 will exit through opening 19 to be dispensed to a person's body, or, if the brush is used as a cleaning device, an item or surface to be cleaned. As discussed in detail below, when used as a pet brush, the liquid from the brush may also be dispensed to a pet. When used as a toilet brush, the liquid will be dispensed for toilet cleaning purposes.

The handle portion 16 may be provided with a transparent viewing "window" portion 42, through which a user can see the level of liquid soap in the brush 10. The window portion 42 is preferably a transparent plastic. In this manner a user does not have to wait until they run out of liquid soap to refill the brush, or be caught in the middle of a bath or shower with no liquid soap in the brush. In addition, a user does not need to open the end-cap to keep checking to see if there is any liquid soap in the brush.

Figure 4:
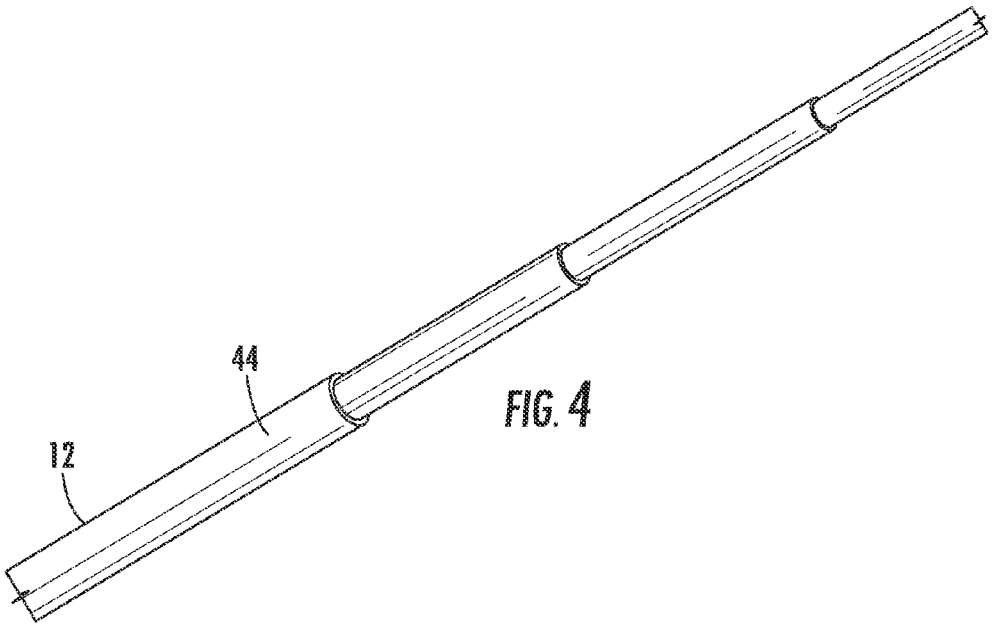
FIG. 4 and FIG. 5 show an isometric view of a handle portion or body portion of the present invention that is telescoping.
Figure 5:
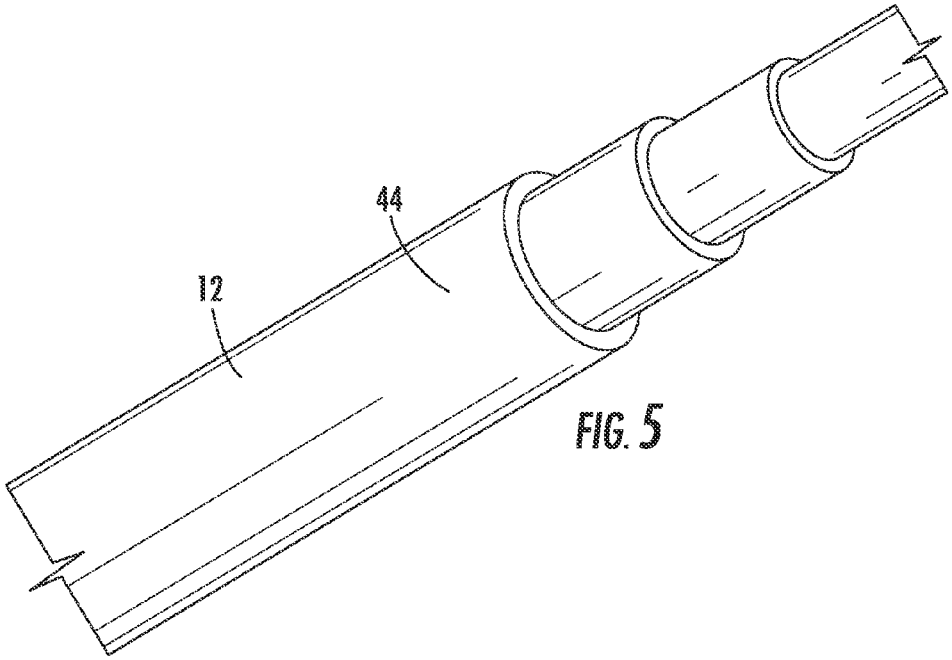

The brush 10 of the present invention may also include a telescoping handle 44, or with a portion of the handle 44 that is telescoping, as shown in FIGS. 4-5. The telescoping handle 44 allows the brush 10 to be adjustable for users of different sizes, or to reach different areas of the body. The telescoping portion may be provided as the handle portion 16, the body portion 12, the neck portion 14, or any combination of those.

Figure 6:
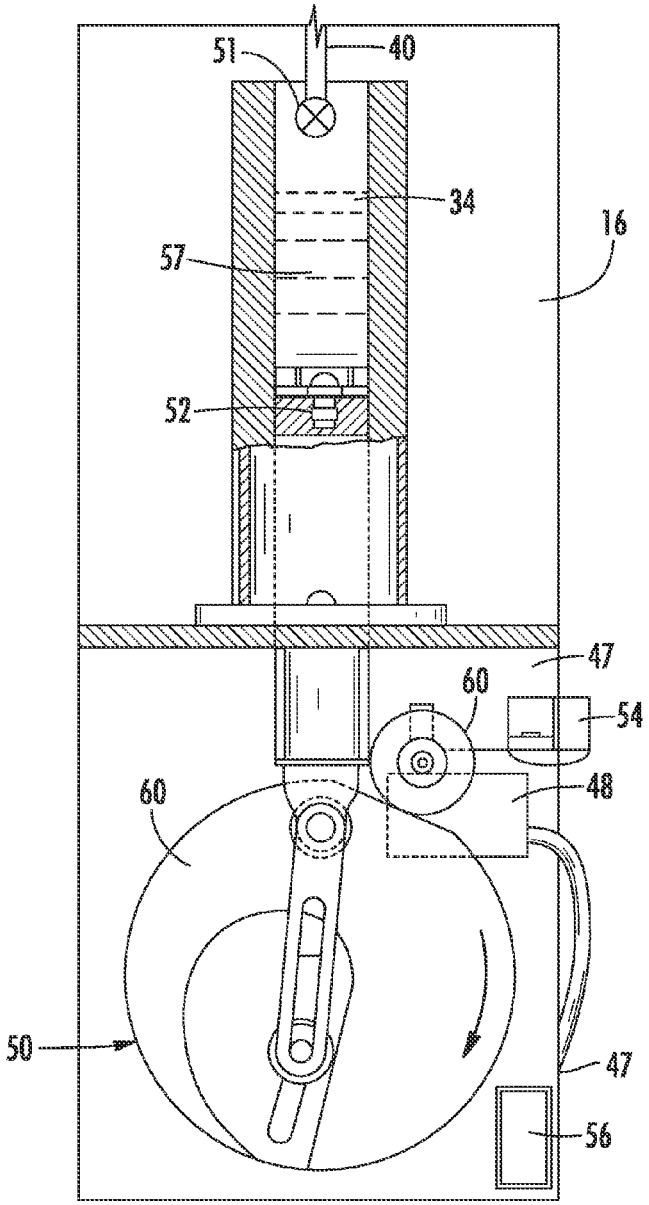
FIG. 6 is a partial cross-sectional view of a handle portion of the present invention showing an illustrative motorized pump dispenser.

The brush 10 may be provided with either a user-actuated or motorized pump 47, which may act as a flow control portion. Such pumps are known in the art of bath and beauty products. An exemplary motorized pump dispenser 47 located adjacent the handle portion 16 is shown to advantage in FIG. 6. The motorized pump 47 may include a battery operated or rechargeable motor 48, gears 49, and linear motion converter 50, and a piston 52 in communication with the linear motion converter arm 50 for translating the movement of the motor 48 and gears 49 to the piston 52. A button 54 is included for actuation of the motor to pump liquid through the brush. Liquid 57 in the reservoir 34 is pumped into tube 40, which is in fluid communication with the reservoir 34. This motorized feature is particularly helpful for example for senior adults with arthritis. The motor 48 operates the pump 47, thereby forcing or otherwise dispensing liquid through the brush 10. The motor may include a valve or several valves to assist in operation. For example, a one-way valve or check valve 51 would allow liquid to flow only in the direction of the brush head 18 when, for example, the pump 47 is actuated. A source of power such as a battery 56 is preferably included in the handle portion and protected from water damage. The motorized pump 47 may be contained in a removable end-cap, allowing access to fill the reservoir by removal of the end-cap containing the pump 47. The pump 47 may also be positioned within the brush body at any convenient position.

As shown in FIGS. 7A and 7B, a bath brush 100 of the present invention may be provided with a folding body 70. In this arrangement, the body 70 may include a hinge 72, with the brush 100 having a first portion 82 including a handle 86 and a second portion 84 including a brush head 76. A user may fold the brush 100 for ease of storage. When in the open position, the first portion 82 and second portion 84 may be held open such as by a locking latch 88 and ring, latch or post 90 or other securing or receiving element or means. The locking latch 88 is preferably spring biased by spring 92 to the closed position and may pivot to attach or disconnect from the receiving element 90. When the latch 88 is disconnected from the ring, latch or post 90, the body 70 may be moved into the open position. A hose 80 running along the length of the brush from a reservoir 74 to the brush head 76 is preferably formed at least partially as a flexible tube or hose adapted to convey liquid soap. The tube or hose 80 is adapted to bend when the brush is in a folded position.

While any of the forgoing embodiments can be used both as a shower or bath brush and as a toilet scrubbing brush, the present invention is also directed to the following embodiments more particularly suited to toilet scrubbing.

Figure 8:
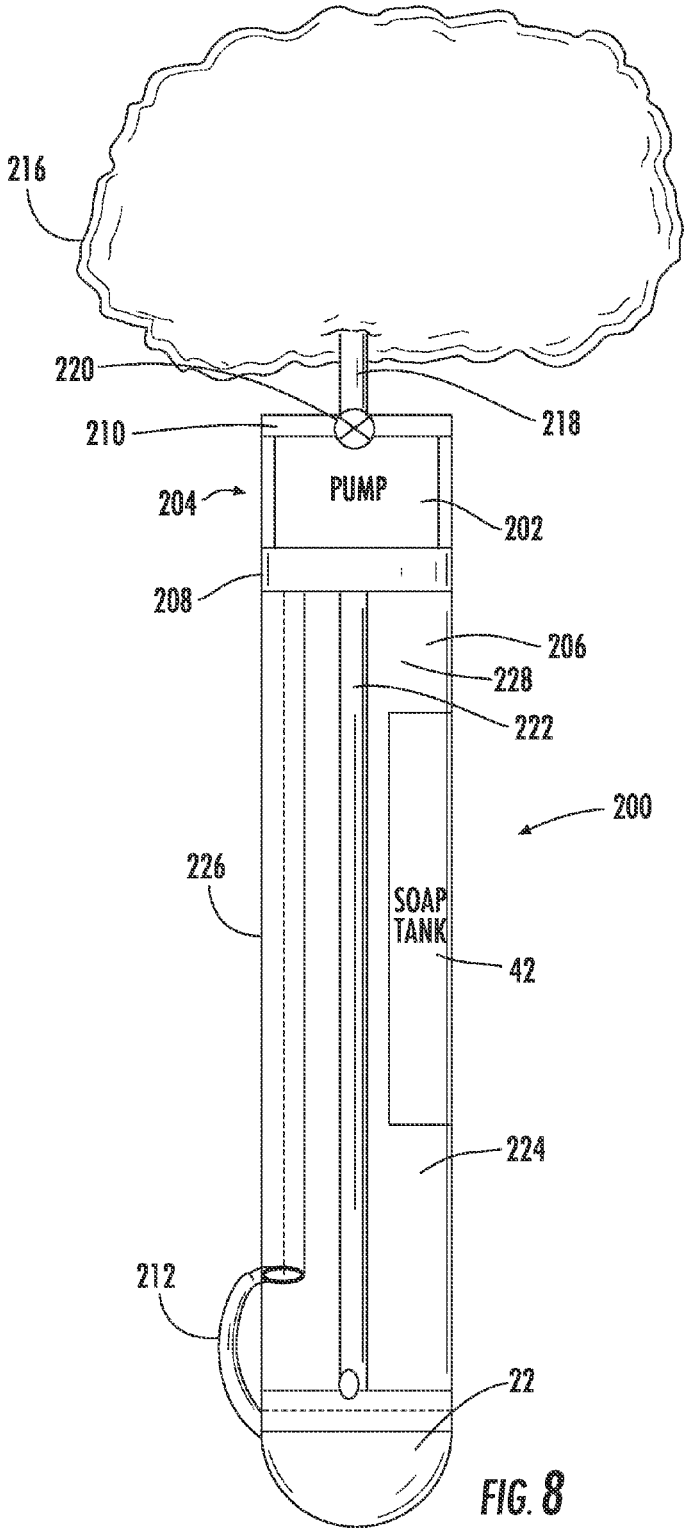
FIGS. 8 and 9 show an embodiment of the present invention particular directed to toilet scrubbing brushes.
Figure 9:
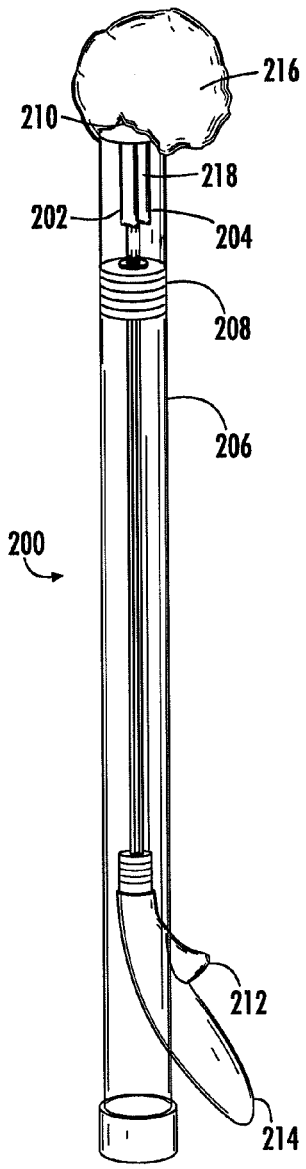

A toilet brush 200 may also be formed according to principles of the present invention. As shown by FIGS. 8-9, the toilet brush 200 includes a reservoir 202 adapted to hold a liquid. The brush 200 is formed as a generally cylindrical tube, the entire body of which can be formed of a transparent plastic, or a portion of which is provided as a transparent window 42. The brush 200 includes a channel 204 at least partially therethrough adapted to house the reservoir 202. A portion of the interior 228 of the brush 200 may house a tube 222 providing fluid communication with a tank portion 224 and the reservoir. Accordingly, liquid housed in the tank 224 may flow from the tube 222 to the reservoir 202. The toilet brush 200 is preferably of a length whereby a user does not have to get too close to a toilet bowl, allowing cleaning while reducing negative aspects of such cleaning.

The brush body 206 is preferably provided with the channel 204 running through the brush body 206. A plunger 208 is provided adjacent the brush head end 210 of the brush 200. The plunger 208 is in communication with a lever and/or trigger 212, which may be positioned at least partly within a handle 214. An actuation rod 226 connects the trigger 212 and the plunger 208. Together, these components act to control the flow of liquid.

A brush head 216 is provided. A passage 218 extends through the brush head 216 and is in communication with the reservoir 202. A valve 220 may be provided where the reservoir 202 communicates with the brush head passage 218. The brush head 216 is preferably angled so as to reach up under the inner rim of a toilet bowl during use.

When the trigger 212 is pulled by a user, the plunger 208 moves toward the brush head 216, compressing the reservoir 202, and moving liquid cleaner from the reservoir through the passage 218 to the brush head 216. The brush 200 may now be used to scrub, for example, a toilet, without the need for a separate cleaning fluid bottle or product. In this manner, the trigger 212/plunger 208/reservoir 202 acts as a user-actuated pump. Alternately, the rod 226 may directly act on or within the reservoir 202, without the need for the plunger 208. It is appreciated that any user-actuable pumping system may be used for any pump described herein without departing from the present invention.

The brush body 206 may be formed as a generally cylindrical tube, at least portions of which are transparent plastic. The handle 214 may preferably extend from the brush body 206 through an opening in the brush body 206 as shown in FIG. 9, forming a "gun" or "firearm" type of grip. This gun-type grip provides for comfortable use of the brush 200 and trigger 212.

End cap 22 is removably attached to an end of the brush 200, allowing for access to the interior 228 for filling, cleaning or the like. The end-cap 22 is preferably formed as previously described. A window 42 is also preferably provided, for viewing the interior 228 of the brush 200.

Figure 11:
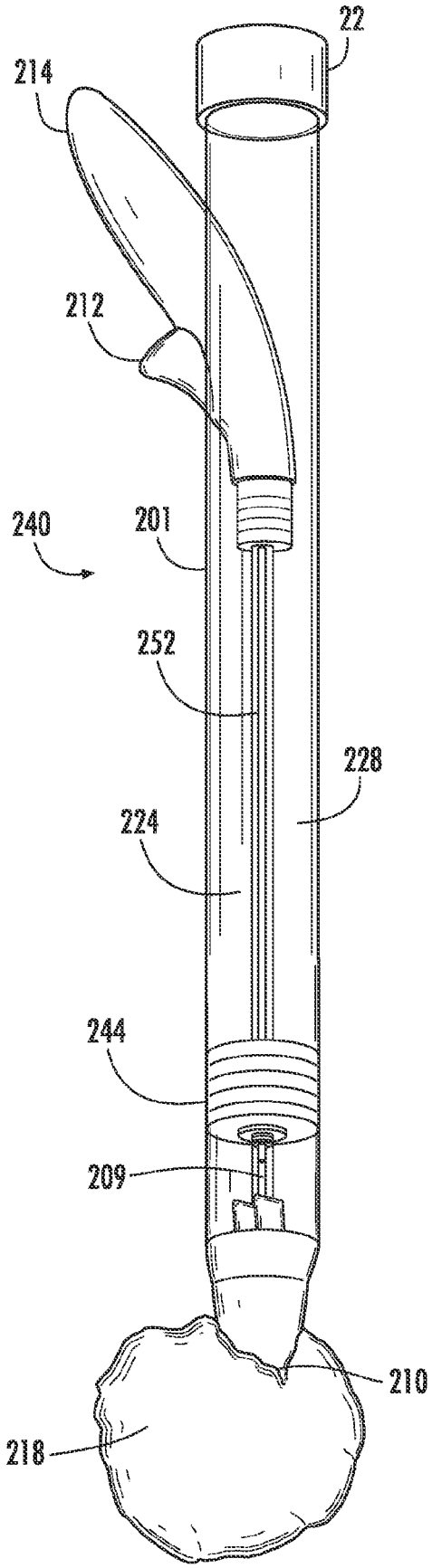
FIG. 11 is a perspective view of another embodiment of a brush according to the present invention.
Figure 12:
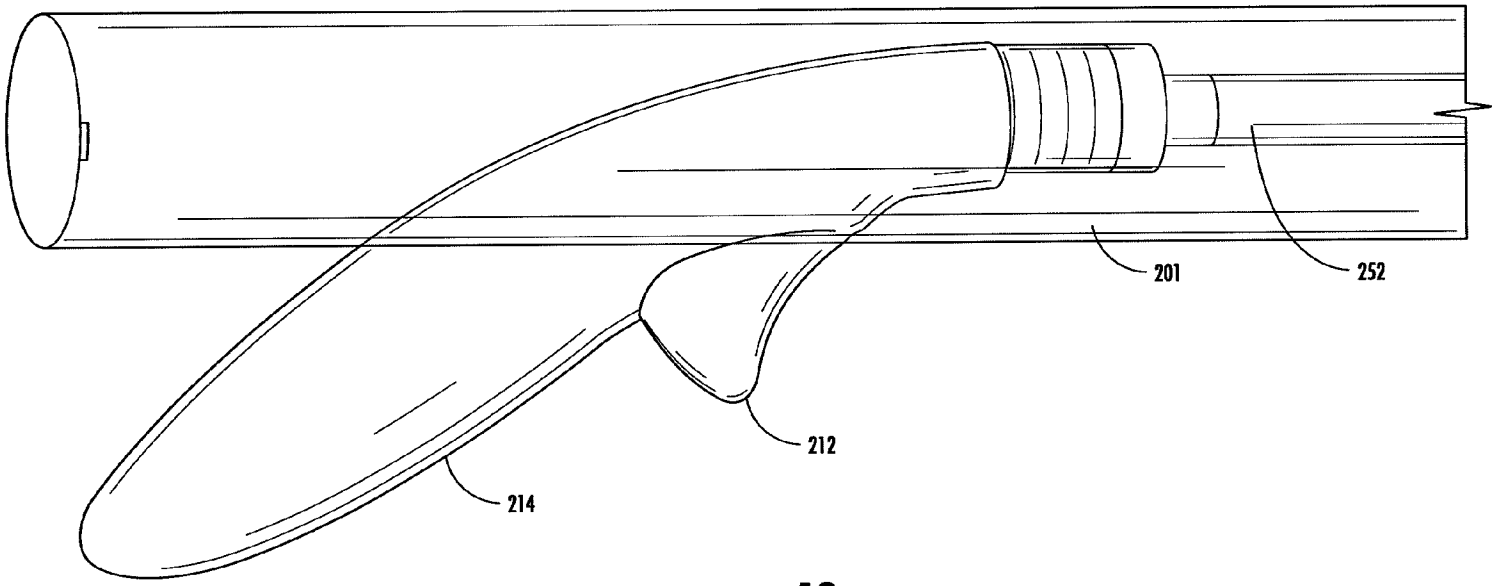
FIG. 12 is a close up view of the handle portion of the brush shown in FIG. 11.
Figure 13:
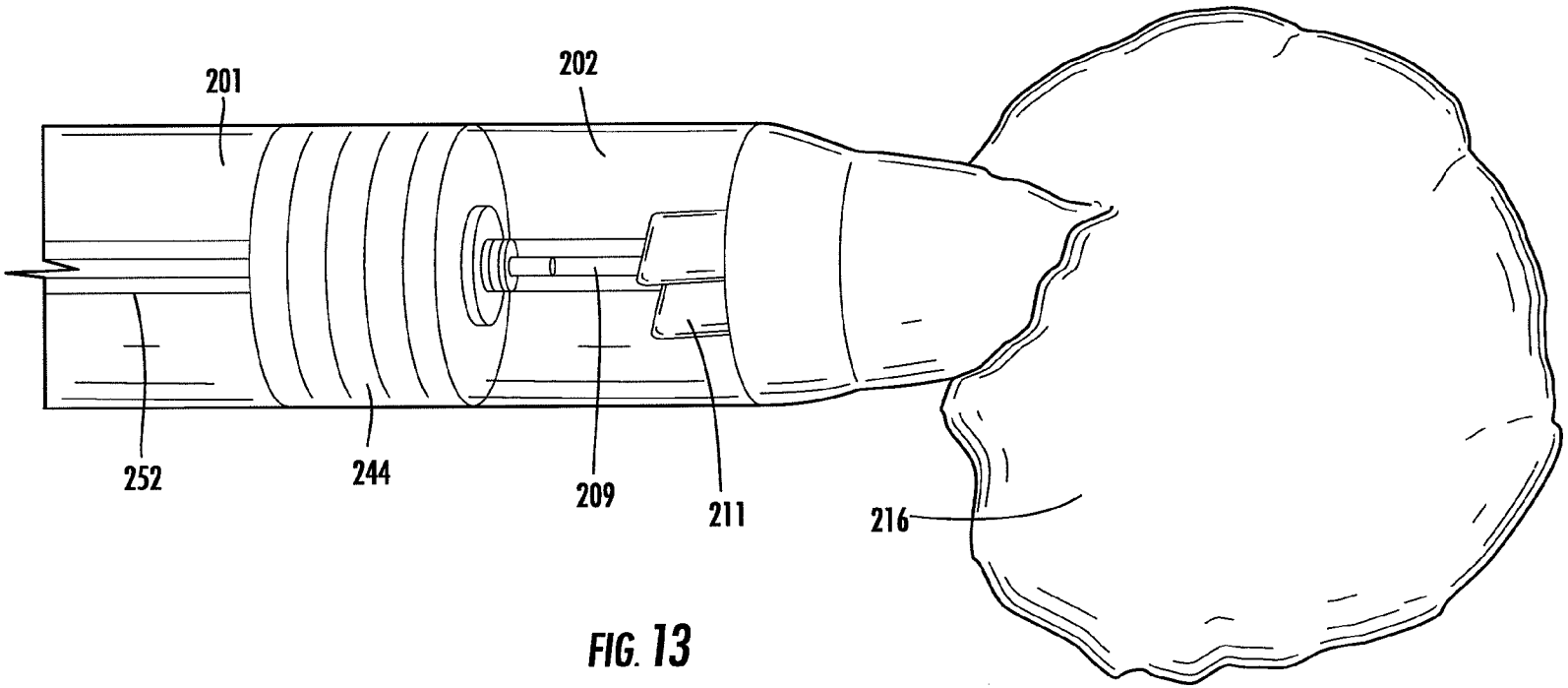
FIG. 13 is a close up view of the valve and brush head portion of the brush shown in FIG. 11.
Figure 14:
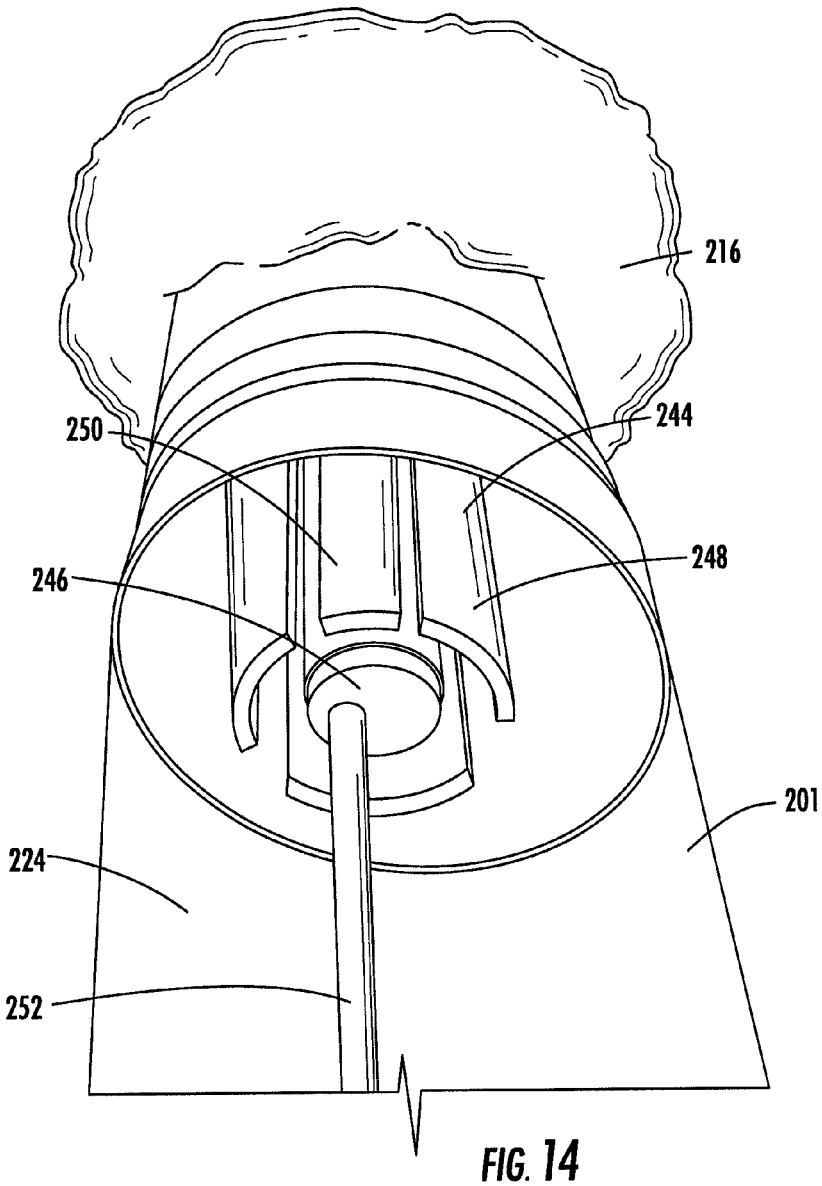
FIG. 14 is a close up perspective view from the bottom of the valve of the brush shown in FIG. 11.

In another embodiment of a brush 240 particularly suited for toilet cleaning, a toilet brush 240 may also be formed according to principles of the present invention. As shown by FIGS. 11-13, the toilet brush 240 is has similar features to the embodiment shown in FIGS. 8-9, and therefore, similar numbering of similar features is used. Brush 240 includes a reservoir 202 portion with a tube 209 configured to transfer a liquid. A support member 211 may be provided around a portion of the tube for support and protection. The support member 211 may also support the brush head 216. The brush 240 includes a channel 204 at least partially therethrough adapted to house the reservoir 202, tube 209 and a tank portion 224.

Rather than using a pump as described herein, in the embodiment shown in FIGS. 11-14, a user-actuated valve 244 is used to control the transfer of liquid from the tank portion 224 to the tube 209, and such valve 244 acts as a flow control portion of the brush 240. The valve 244 is positioned between and separates the tank portion 224 and the reservoir portion 202. The valve 244 includes a valve stem 246 and a valve body 248 moveable in relation to the valve stem 246. A valve passage 250, such as a tube, is provided running through the valve 244, providing fluid communication between the tank portion 224 and the reservoir portion 202 when the valve 244 is in the open position.

An actuation rod 252 is provided running through the interior 228 of the brush 240. The actuation rod is connected to the trigger 212 at one end, and the valve body 248. Actuation of the trigger 212 forces the rod 252 and the valve body 248 toward the brush head end 210, opening the valve 244 and allowing fluid to flow through valve passage 250. The handle 214 if preferably of a "gun"-type shape.

The brush 240 is normally preferably in the resting or un-actuated position, where the valve 244 is closed. The valve 244 may be biased, such as by a spring, to the closed position. Actuation of the trigger 212 causes the valve 244 to open, and release of the trigger will allow the valve 244 to close. It is appreciated that any user-actuable valve, as would be known in the art, may be used as valve 244 without departing from the teachings of the present invention. In another embodiment, the rod 252 may be connected to the valve stem 246, and the valve body 248 will remain stationary. When the rod 252 moves the valve stem 246, the valve 244 would be opened.

In any embodiment described herein, the brush head may be in communication the body of the brush with an accordion-type or ribbed type hose, so that the brush head can swivel on a brush hinge, and be positioned at different angles.

The brush may be formed from different sized, based on the use, such as a longer brush for bath brush use, and a shorter brush for toilet brush use.

The brush body shape is ergonomically designed, in that it is preferably wide so that arthritic fingers do not have to bend or cramp to hold it. In addition, the sweeping angle of the brush body is designed so that it can reach various parts of the body (when used as a shower brush) without difficult physical movement or strain. Alternately, only the handle portion may be ergonomically designed, while the body of the brush is straight, such as shown in FIGS. 11-14. This "gun" type handle provides ergonomic attributes as well, and assists in pointing and positioning the brush without having to bend the hand or arm at an uncomfortable position.

A scrub brush according to the present invention would also be of great use for pet care. A user could wash a pet including the underside of the pet easily while dispensing liquid cleaner directly to the pet in a convenient single item. The angle of the handle of the brush of the present invention makes it easier to clean the underside and side of the pet facing away from the user (pet owner). The pump makes it easier to apply liquid soap for cleansing. The bristles 27 of the brush head 26 could be formed to make the brush particularly compatible with pet skin and hair.

Figure 10:
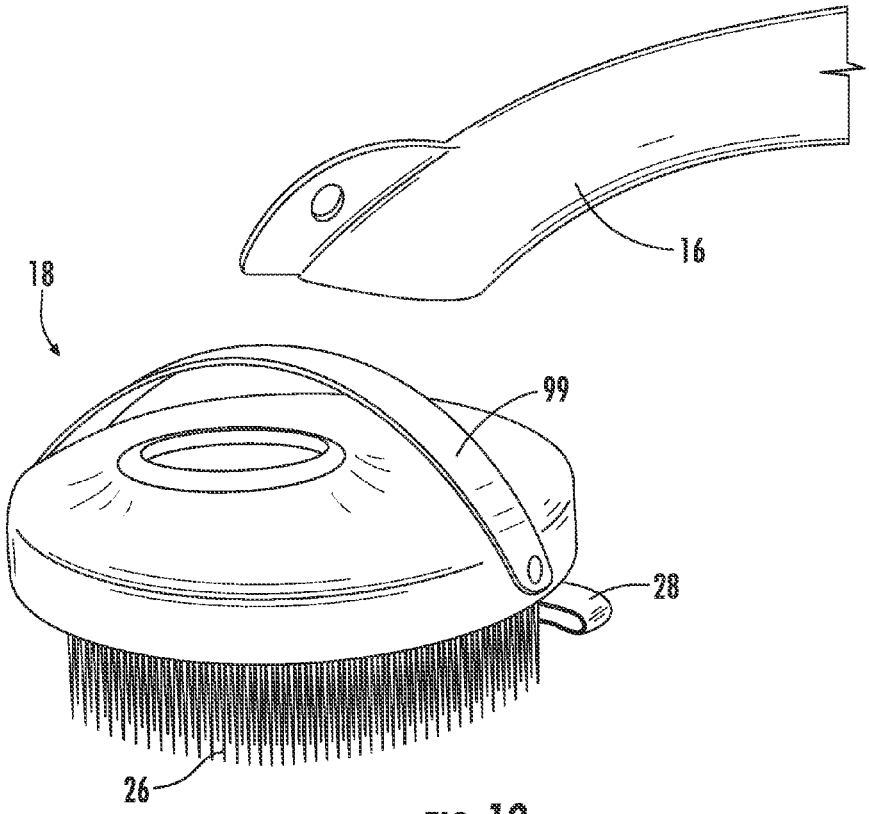
FIG. 10 shows the brush head as a removable scrubbing pad.

In addition, in another embodiment, shown in FIG. 10, the brush head 18 could be removable from the handle 16 and used as a separate scrubbing pad without the handle 16. In this arrangement, one or a plurality of brush heads could be used with the handle, and offered in a kit, or with after-market brush heads. The various replacement brush heads could include different types of bristles for different uses. The brush heads 18 would attach by snapping engagement to the brush body 12. As shown in FIG. 10, an exemplary replacement brush head, a hand strap 99 could be provided, allowing a user to use the brush head by hand.

Figure 15:
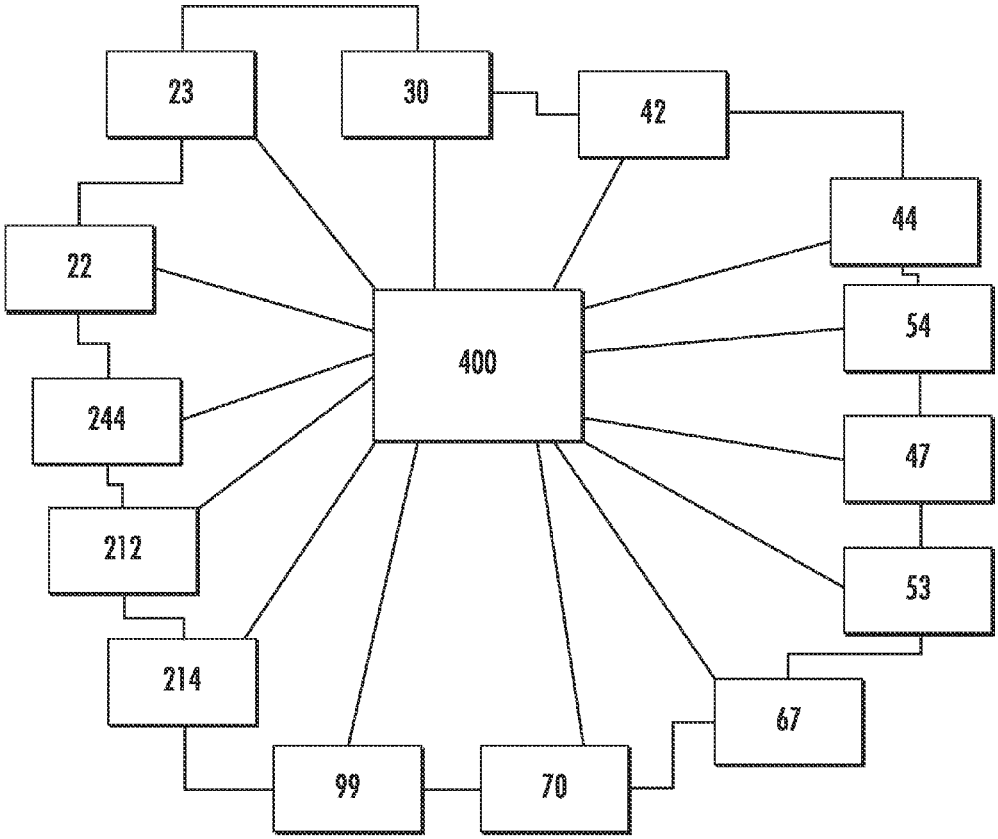
FIG. 15 shows a schematic view of various possible combinations of features of a brush according to the present invention.

It is appreciated that the size of the various parts of scrub brush of the present invention could be varied to suit any user's size, scrubbing needs or a particular use. In addition, any combination of the features, elements or components disclosed herein could be combined to form a brush having features of the present invention, and are considered within the scope of the present invention. Possible combinations of such a brush 400 are shown schematically in FIG. 15.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What I claim is:

1. A scrub brush, comprising:

a brush body, the brush body including a channel at least partially through the body, the brush body having a first end and a second end;

the brush body including a brush head receiving portion adjacent the first end, wherein at least a portion of the brush body is formed as a transparent viewing window;

a brush head removably engagable with the brush head receiving portion;

the bush body including a handle portion adjacent the second end, the handle portion including an actuator, the handle portion including a reservoir adapted to receive a liquid, the handle portion including a pump, the pump actuated by the actuator;

the handle portion having external threads formed adjacent the second end;

a cap sized to fit over the second end of the handle portion and seal the reservoir, the cap having internal threads adapted to mate with the threads of the handle portion;

a hanging flange formed along the spine of the body of the brush adjacent the brush head receiving portion having an opening therein; and, a liquid cleaner dispensing tube providing communication between the brush head and the reservoir;

whereby actuation of the actuator delivers liquid cleaner from the reservoir to the brush head for cleaning; and wherein the brush head further comprises a hand strap configured to provide for use of the brush head as a separable scrubbing instrument apart from the brush body.

2. The brush of claim 1, wherein at least a portion of the brush is telescoping to selectively change a length of the brush.

3. The brush of claim 1, wherein the pump is a motorized pump.

4. The brush of claim 1, wherein the brush body has an ergonomic size and shape for ease of use by senior adults or adults having difficulties manipulating brushes with their hands.

5. The brush of claim 1, wherein the brush body is foldable.

6. The brush of claim 1, wherein a string is inserted through the opening in the hanging flange and formed into a loop, and wherein hanging the brush by the string will position the brush with the brush head up and the handle portion down.

7. The scrub brush of claim 1, wherein a trigger is provided for actuating the pump.

8. A scrubbing brush kit, comprising:

a brush body, the brush body including a channel at least partially through the body, the brush body having a first end and a second end;

a first removable brush head of a first arrangement and at least one second removable brush head of a second arrangement, each brush head removably attachable to the first end;

the bush body including a handle portion adjacent the second end, the handle portion including an actuator, the handle portion including a reservoir adapted to receive a liquid cleaner, the handle portion including a pump, the pump actuated by the actuator;

wherein at least a portion of the handle portion contains a transparent window adapted to show the contents of the reservoir;

the handle portion having external threads formed adjacent the second end;

a cap sized to fit over the second end of the handle portion and seal the reservoir, the cap having internal threads adapted to mate with the threads of the handle portion;

a hanging flange having an opening formed along the spine of the body of the brush adjacent the brush head portion;

a liquid cleaner dispensing tube in communication with the brush head and the reservoir;

whereby actuation of the actuator delivers liquid cleaner from the reservoir to the brush head for cleaning; and wherein at least one of the first removable brush head or the second removable brush head comprises a hand strap configured to provide for use of one of the first removable brush head or the second removable brush head as a separable scrubbing instrument apart from the brush body.

9. The brush of claim 8, wherein at least a portion of the brush is telescoping to selectively change a length of the brush.

10. The brush of claim 8, wherein the pump is a motorized pump.

11. The brush of claim 8, wherein the brush body has an ergonomic size and shape for ease of use by senior adults or adults having difficulties manipulating brushes with their hands.

12. The brush of claim 8, wherein the brush body is foldable.

* * * * *